US007546927B2

(12) United States Patent
Lowry et al.

(10) Patent No.: US 7,546,927 B2
(45) Date of Patent: Jun. 16, 2009

(54) PRODUCT TRAY INSERT

(76) Inventors: James W. Lowry, 405 Treeshore La., Franklin, TN (US) 37069; Ronald W. Kroeckel, 4817 Peninsula Pointe Dr., Hermitage, TN (US) 37076

( * ) Notice: Subject to any disclaimer, the term of this patent is extended or adjusted under 35 U.S.C. 154(b) by 601 days.

(21) Appl. No.: 10/905,625

(22) Filed: Jan. 13, 2005

(65) Prior Publication Data

US 2006/0151410 A1 Jul. 13, 2006

(51) Int. Cl.
*B65D 81/00* (2006.01)

(52) U.S. Cl. ..... 211/126.1; 211/126.16; 206/557; 206/594

(58) Field of Classification Search ..... 206/509, 206/511, 386, 586, 600, 821, 488, 489, 557, 206/594, 584; 211/126.1, 126.13; 229/915, 229/918, 931, 933, 120.1, 120.13; 47/1.1
See application file for complete search history.

(56) References Cited

U.S. PATENT DOCUMENTS 2,026,417 A * 12/1935 Conway et al. ..... 119/490
2,273,390 A * 2/1942 Warren ..... 229/120.1
2,527,221 A * 10/1950 Huye et al. ..... 229/120.1
2,828,047 A * 3/1958 Weiselberg ..... 206/189
3,048,323 A * 8/1962 Stauffer ..... 206/418
3,147,908 A * 9/1964 Clemens ..... 206/512
3,185,379 A * 5/1965 Kohlhaas ..... 206/599
3,220,633 A * 11/1965 Swane ..... 229/198.1
3,246,824 A * 4/1966 Gardner ..... 206/386
3,704,824 A * 12/1972 Croley ..... 229/117.08
3,831,836 A * 8/1974 Ellison et al. ..... 229/199
3,904,066 A * 9/1975 Wilson ..... 220/7
3,916,030 A * 10/1975 Bard et al. ..... 426/113
3,931,889 A * 1/1976 Roccaforte ..... 206/493
4,019,672 A * 4/1977 Giannini ..... 206/592
4,082,214 A * 4/1978 Baker ..... 229/120.01
4,236,664 A * 12/1980 Hartelmuller ..... 229/191
4,607,785 A * 8/1986 Croley ..... 229/117.07
5,035,323 A 7/1991 Daniels et al.
5,251,753 A 10/1993 Pigott et al.
5,415,342 A * 5/1995 Harrelson ..... 229/120.38
5,522,539 A * 6/1996 Bazany ..... 229/199
5,544,806 A * 8/1996 Anderson et al. ..... 229/178
5,896,995 A 4/1999 Murray et al.
5,918,751 A 7/1999 Kelly
5,938,036 A 8/1999 Villemure
6,016,627 A * 1/2000 Nobile ..... 47/1.1
6,227,442 B1 * 5/2001 Evans, Jr. ..... 229/122.31
6,302,274 B1 * 10/2001 Ridgeway ..... 206/583
6,308,850 B1 * 10/2001 Coom et al. ..... 220/62.1

(Continued)

FOREIGN PATENT DOCUMENTS

JP 10167253 6/1998

*Primary Examiner*—Katherine W Mitchell
*Assistant Examiner*—Colleen M Quinn
(74) *Attorney, Agent, or Firm*—Clausen Miller, PC

(57) ABSTRACT

A product tray insert that helps hold a vertical post in place is provided. The insert is placed within a product tray and has upwardly folding retaining flaps that capture the bottoms of the vertical posts between the flaps and a side of the tray. The tray insert is particularly useful for packaging systems that do not have a large rectilinear product to fit the posts against and that do not hold the posts at their ends.

1 Claim, 2 Drawing Sheets

U.S. PATENT DOCUMENTS 6,357,587 B1 3/2002 Melms, Jr.
6,622,423 B1 * 9/2003 Riccardi ..... 47/1.1
7,014,160 B2 * 3/2006 Muyskens ..... 248/346.03
7,111,735 B2 * 9/2006 Lowry ..... 206/586
7,281,648 B2 * 10/2007 Lowry ..... 229/199
2005/0145686 A1 * 7/2005 Curtis et al. ..... 229/122.3

* cited by examiner

PRODUCT TRAY INSERT

FIELD OF THE INVENTION

This patent relates to the packaging arts. More particularly, this patent relates to a product tray insert that helps hold a vertical post in place.

DESCRIPTION OF THE RELATED ART

Wound paper posts are used in the packaging industry to provide structural support to packaging systems and to enable stacking of heavy loads on top of the post during storage and transport. Typically, a vertically oriented post is fitted to the vertical edge of a product (such as a large household appliance) and held in place between the vertical edge of the product and the packing container. In open sided packaging systems such as Sonoco Product Company's SONOVIEW™ packaging system, the vertical posts are often held at their respective ends between the edge of the product and top and bottom caps.

In still other packaging applications there is no product edge to use as a support for the vertical posts. In such cases the post can be pushed, pulled or forced out of position. If the post is not positioning correctly, or is pushed out of position, the load cannot be transferred down through the post.

One example of a packaging system for which there is no product edge to use as a post support is the SONOPOP™ packaging system developed by Sonoco Products Company. The SONOPOP™ packaging system is intended for use by club store and other retailers for displaying products in the same package in which they are shipped from the vendor. The SONOPOP™ system is a post-in-post type system. That is, the system uses a post-inside-a-post structure to give the system strength and stability. The SONOPOP™ packaging system comprises a plurality of corrugated trays for holding products, outer posts that hold the trays apart, and inner posts that slide inside the outer posts to lock the system together and provide axial compression strength. The entire assembly may be carried on a standard pallet and wrapped in an outer wrap to protect the products from dust and damage during shipment.

Each corrugated tray has die-cut openings large enough to allow the inner posts to fit through but not the outer posts. The outer posts space the trays apart and provide a platform on which additional trays may be placed. Significantly, the inner posts help hold and position the outer posts while the system is being assembled and during use.

The number of outer posts per tray level can vary, and usually depends on the total weight of the palletized unit and the dimensions of the trays. For example, a 40" by 48" palletized unit having four layers of products and an overall weight of 480 lbs. (120 pounds per layer—trays typically are limited to 40 pounds for lifting purposes, so a system having 120 pounds per layer might have four trays arranged within a larger tray on each layer) might require just four outer posts located at the corners of each tray. A unit having a total product weight of 800 lbs. (200 pounds per layer) might require six posts, one at each corner and two located at the midpoints of the two longest opposing sides. A unit having a total product weight of 960 lbs. (240 pounds per layer) might require eight posts, one at each corner and one located midway between each pair of corners. If even more outer posts are needed they can be symmetrically arranged away from the sides of the trays toward the center.

With the SONOPOP™ product packaging system, the greater the product weight on each tray the higher the number of outer posts per tray required. Since the inner posts are used to hold and position the outer posts during assembly and use, increasing the number of outer posts requires increasing the number of inner posts. Yet increasing the number of inner posts adds to the cost of the system. The present invention solves the problem of increasing material cost by providing a tray insert that includes fold-up and die cut features for holding and positioning the outer posts during assembly and use.

Thus it is an object of the present invention to provide a tray insert that can hold a vertical post in place when there is no large product having an edge against which the vertical post can be secured.

Another object of the invention is to provide a tray insert that can hold a vertical post without the need for adhesive or other holding means.

Another object of the invention is to provide a tray insert that holds and positions outer posts in a post-in-post packaging system while the system is being assembled.

Still another object of the invention is to provide a tray insert that reduces the number of inner posts required in a post-in-post packaging system.

Further and additional objects will appear from the description, accompanying drawings, and appended claims.

SUMMARY OF THE INVENTION

The present invention is a product tray insert that helps hold a vertical post in place. The insert can be used with shelving or packaging systems incorporating vertical posts to support shelves or trays. The tray insert has upwardly folding retaining flaps that capture the bottoms of the vertical posts between the flaps and a side of the tray. The tray insert is particularly useful for packaging systems that do not have a large rectilinear product to fit the posts against and that do not hold the posts at their ends. The tray insert can be used with a post-in-post packaging system such as that described in U.S. patent application Ser. No. 10/615,814 to eliminate or reduce the need for inner posts.

In one embodiment of the invention the tray insert is made from a substantially flat sheet of material and is configured to be placed within a tray. The insert comprises a pair of retaining flaps such that the retaining flaps and the tray sidewall form a base for holding a vertical post upright. The vertical post is held in place by lateral forces imposed on the post by the retaining flaps and the tray sidewall.

The retaining flaps are defined by an edge of the insert, a cut line extending from the edge, and fold lines extending from the cut line to the edge. The fold lines extend diagonally from the cut line. The insert may also comprise cut out sections for accommodating additional posts.

In a second embodiment of the invention, the insert comprises a single retaining flap and the vertical post is held in place by lateral forces imposed on vertical post by the retaining flap and the tray sidewall. The retaining flap is rectangular and is defined by a fold line extending between two die cut lines and an edge of the tray insert.

THE DRAWINGS

FIG. 1 is a top plan view of a product tray insert according to the present invention.

FIG. 1*a* is a close up view of an alternative embodiment of the tray insert of FIG. 1.

DETAILED DESCRIPTION OF THE INVENTION

The invention is a tray insert for use with shelving and/or packaging systems that incorporate vertical support posts in their structure, including the post-in-post packaging system described in Sonoco's pending U.S. patent application Ser. No. 10/615,814. The tray insert helps hold vertical support posts in place.

Figure 1:
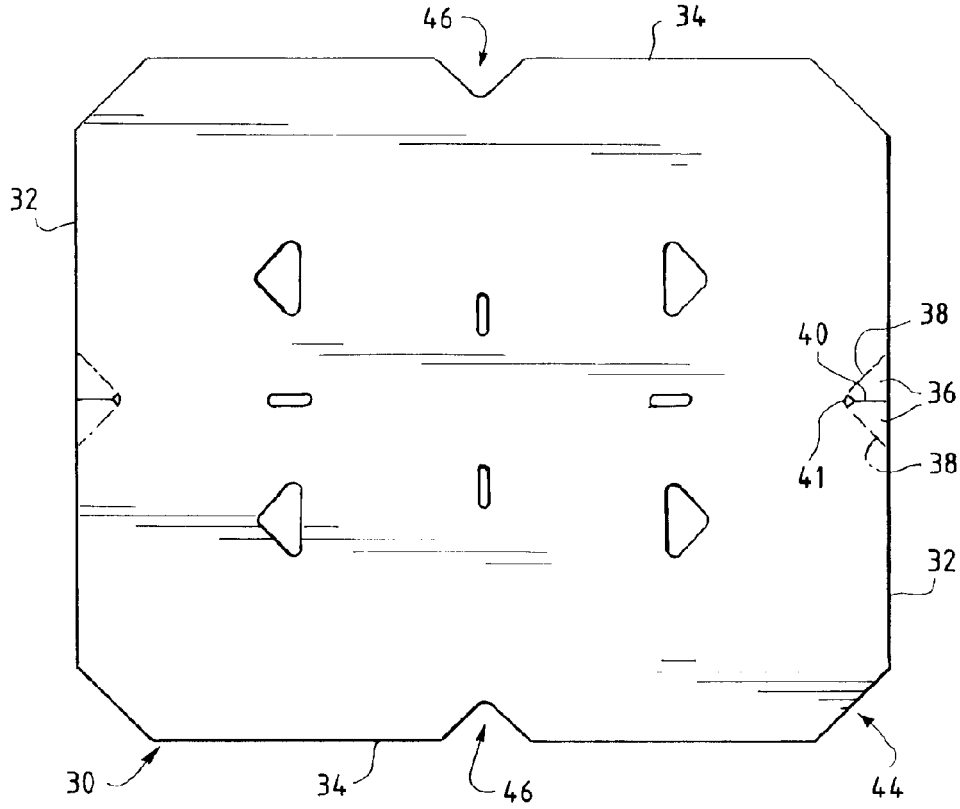
Figure 2:
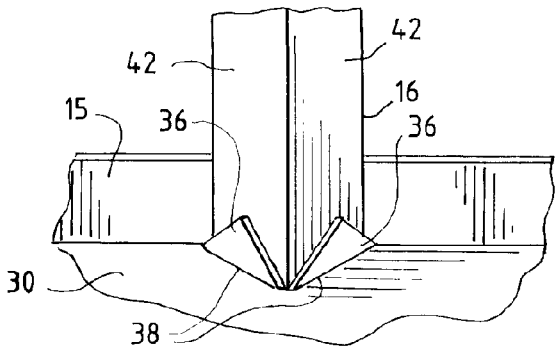
FIG. 2 is a perspective view of the product tray insert of FIG. 1 in use.

FIG. 1 shows a tray insert 30 according to one embodiment of the present invention. FIG. 2 shows the insert 30 being used in a tray 12 to help hold upright a vertical post 16. The tray comprises a bottom panel 13 and side panels 15 extending upward from the periphery of the bottom panel 13. Preferably the tray insert 30 has dimensions similar to that of the tray bottom panel 13.

Referring to FIG. 1, the tray insert 30 preferably is made from a substantially flat corrugated sheet defined by pairs of opposing edges 32, 34. The tray insert 30 comprises matched pairs of post retaining flaps 36 defined by a tray edge 32, diagonal fold lines 38 and a die cut line 40. The die cut line 40 extends a short distance perpendicularly inward from an edge 32 of the tray insert 30 and terminates in a distal end 41. The diagonal fold lines 38 extend diagonally from the distal end 41 of the die cut line to the edge 32.

When folded along the fold lines 38, the retaining flaps 36 become two sides of a three-sided retaining base for holding upright a vertical post 16, as shown in FIG. 2. The third side of the retaining base is formed by the tray sidewall 15. The retaining flaps 36 and tray sidewall 15 hold the post 16 in an upright position by exerting lateral forces of the post 16.

The retaining flaps 36 may be located wherever there is a need to hold and secure a vertical post. For example, and without limitation, the retaining flaps 36 shown in the figures are located along opposing edges 32 of the insert 30 midway between the corners of the insert 30.

The angle formed by the diagonal fold lines 38 and the die cut line 40 is a function of the geometry of the post to be held by the retaining flaps 36. For example, in the embodiment shown in FIG. 2, the outer post 16 is three-sided and the angle formed by the two inward facing sides 42 is 90 degrees. The angle formed by the diagonal fold lines 38 and the die cut line 40 is 45 degrees so that when the retaining flaps 36 are raised they form a ninety degree angle and fit snugly against the inward facing sides 42 of the post 16.

Figure 1A:
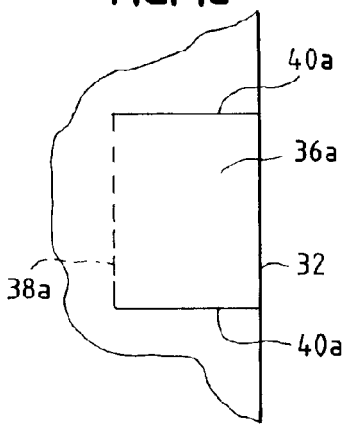

The retaining flaps can be any shape suitable for holding a vertical post. For example and without limitation, as shown in FIG. 1*a*, a fold line 38*a* can extend between two parallel die cut lines 40*a* parallel to the edge 32 of the tray insert, resulting in a rectangular retaining flap 36*a*. This shape is particularly suitable for a flat post, for example, one having a racetrack-shaped cross section. This shape flap could also be used to secure a corner post having a substantially rectangular cross section.

The product tray insert 30 may also comprise corner cut out sections 44 located at the corners of the insert 30, edge cut out sections 46 located along the edges 34 of the insert 30 and center cut out sections 48 located away from the edges 32, 34 toward the center of the insert 30. These cut out sections 44, 46 and 48 enable posts 18 to be inserted through the tray insert 30 and thus can be located wherever a through post is located. They can be any desired shape. If the tray insert 30 is to be used with the post-in-post type packaging system described below, the cut out sections should be shaped to allow insertion of the inner posts 18 through the cut out sections but not the outer posts 16. The cut out sections also help hold the posts 18 in place, but not as securely as the retaining flaps 36.

The product tray insert 30 can be used with shelving and/or packaging systems to help hold vertical posts in place where the posts cannot be secured against an edge of the product. Without a large rectilinear product such as an appliance to fit the posts against and if not held in place at the ends of the post by, for example, foamed shaped top and bottom trays, the posts can be pushed, pulled or otherwise forced out of position. If the posts are not positioned correctly, the axial load may not be transferred down through the posts, resulting in crushed or otherwise damaged products. The product tray insert 30 of the present invention solves this problem by holding the posts in their correct positions.

The tray insert 30 also makes easier assembly of a post-in-post packaging system 10 such as that described in co-owned U.S. patent application Ser. No. 10/615,814 and shown in FIGS. 3-5. The post-in-post packaging system 10 comprises vertically arranged trays 12 for holding products, inner posts 16 inserted through openings 24 in the trays to hold the trays 12 in vertical alignment, and outer posts 16 slid over the inner posts 18 to support the trays 12 and space them apart. The bottommost tray 12 (FIG. 3) rests on a standard pallet 20. The entire assembly is wrapped in transparent plastic film (not shown) to protect the products (not shown) on the trays 12 from dust and damage.

Figure 4:
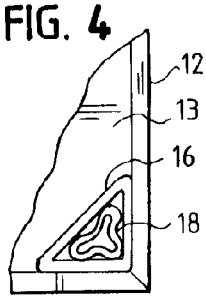
FIG. 4 is a top view of a portion of the packaging system of FIG. 3.
Figure 5:
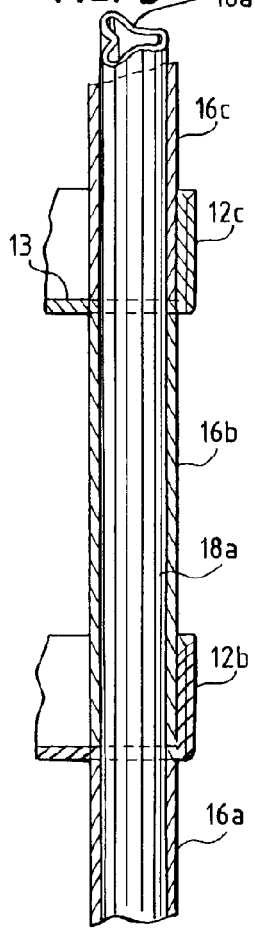
FIG. 5 is a cross-sectional view of the post-in-post packaging system of FIG. 3 taken along line 5-5.

The system 10 is referred to as a post-in-post system because the inner posts 18 fit within the outer posts 16 as shown in FIGS. 4 and 5. The inner posts 18 hold and position the outer posts 18 while the system 10 is being assembled and lock the system 10 together. Both the inner and outer posts 18, 16 preferably are made from wound paperboard, although other materials may be used for the posts, including but not limited to plastic and metal.

Figure 3:
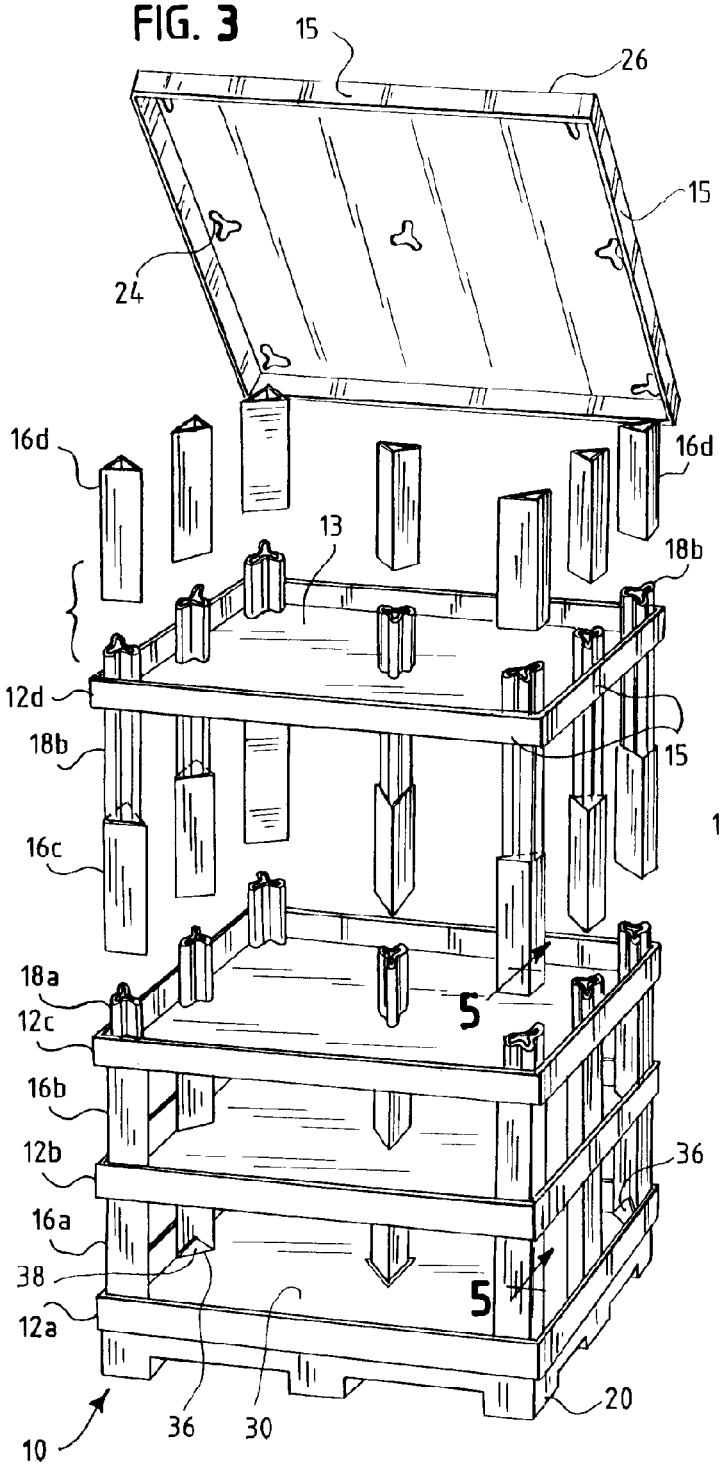
FIG. 3 is a perspective view of a product tray insert used in a post-in-post packaging system

Each tray 12 comprises a bottom panel 13 and side panels 15 extending upward from the periphery of the bottom panel 13. Openings 24 are die cut in the bottom panel 13. There may be four, five, six, seven, eight or any number of outer posts 16 used to support each tray 12; there should be an equal number of openings 24 die cut in the bottom panel 13 of each tray 12. For example, a seven post system is shown in FIG. 3.

The outer posts 16 bear the entire stacking load of the system 10. Because of the axial strength of the outer posts 16, the system 10 is strong enough to support the weight of the products on the trays 12, withstand the vibration and impact forces that can occur during shipping, and withstand the weight of one or more units 10 stacked on top. The system is particularly suited for shipping and displaying irregularly shaped items and items that cannot withstand vertical stacking forces, such as soft-packaged goods, since the products do not bear the stacking load.

To assemble the post-in-post packaging system 10, the inner posts 18 are inserted through the trays 12 and then the outer posts 16 are slid over the inner posts 18. The inner posts 18 not only hold the outer posts 16 in place, they also keep the trays 12 vertically aligned.

The greater the product weight on each tray 12 the higher the number of outer posts 16 required to support the trays 12 and the overall system 10. Since the inner posts 18 are used to hold and position the outer posts 16, increasing the number of outer posts 16 requires increasing the number of inner posts

18. The product tray insert 30 of the present invention reduces the need for more inner posts 18 by providing an alternate means for holding and positioning the outer posts 16. By placing a tray insert 30 into each tray 12, the outer posts 16 can be held in place by the tray insert retaining flaps 36 instead of additional inner posts 18. FIG. 3 shows a tray insert 30 placed within bottom tray 12*a* to help hold in place the outer posts 16*a*. Tray inserts 30 could also be used on the other trays as well.

Thus there has been described a product tray insert that helps hold a vertical post in place. The insert can be used with shelving or packaging systems incorporating vertical posts to support shelves or trays. The tray insert has upwardly folding retaining flaps that capture the bottoms of the vertical posts between the flaps and a side of the tray. The tray insert is particularly useful for packaging systems that do not have a large rectilinear product to fit the posts against and that do not hold the posts at their ends. The tray insert can be used with a post-in-post packaging system such as that described in U.S. patent application Ser. No. 10/615,814 to eliminate or reduce the need for inner posts.

Other modifications and alternative embodiments of the invention are contemplated which do not depart from the scope of the invention as defined by the foregoing teachings and appended claims. It is intended that the claims cover all such modifications that fall within their scope.

What is claimed is:

1. An improved packaging system comprising a substantially rectangular tray and a separate, elongated vertical post, the tray having a bottom panel and side panels extending upwardly from the bottom panel, the vertical post abutting one of the side panels when the vertical post is placed within the tray, the improvement comprising:

a substantially flat insert having four corners and a perimeter edge, the insert configured to be placed within the tray adjacent to and in contact with the tray bottom panel to cooperate with the tray in supporting the vertical post, the insert comprising a pair of triangular shaped retaining flaps located between two of the corners of the insert, each retaining flap having a first free side defined by the perimeter edge, a second free side defined by a cut line extending perpendicularly from the perimeter edge wherein said pair of retaining flaps share the same single common cut line defining their respective second sides, and a third side defined by a diagonal fold line extending diagonally from the perimeter edge to the cut line, each retaining flap joined to the bottom panel along the diagonal fold line;

wherein the vertical post is wedged between one of the side panels and the retaining flaps.

* * * * *